US006616515B2

(12) United States Patent
Dwyer

(10) Patent No.: US 6,616,515 B2
(45) Date of Patent: Sep. 9, 2003

(54) UNIVERSAL JOINTING ATTACHMENT FOR INSERTED TOOTH CARBIDE HEADS

(76) Inventor: David L. Dwyer, 3300 Clinton Ave., Richmond, CA (US) 94805

( * ) Notice: Subject to any disclaimer, the term of this patent is extended or adjusted under 35 U.S.C. 154(b) by 0 days.

(21) Appl. No.: 09/954,249

(22) Filed: Sep. 17, 2001

(65) Prior Publication Data

US 2003/0054737 A1 Mar. 20, 2003

(51) Int. Cl.[7] ..... B24B 7/28
(52) U.S. Cl. ..... 451/65; 451/415; 451/438
(58) Field of Search ..... 451/45, 47, 48, 451/65, 72, 160, 177, 193, 203, 208, 224, 229, 249, 259, 260, 278, 280, 293, 371, 415, 419, 420, 421, 422, 438, 439

(56) References Cited

U.S. PATENT DOCUMENTS

| | | | | | |
|---|---|---|---|---|---|
| 993,367 | A | | 5/1911 | Harper | |
| 3,354,589 | A | * | 11/1967 | Postula et al. | 451/421 |
| 3,683,564 | A | * | 8/1972 | Lawrence | 451/421 |
| 3,691,702 | A | * | 9/1972 | Smith et al. | 451/421 |
| 3,828,486 | A | * | 8/1974 | Bonke | 451/421 |
| 3,991,525 | A | * | 11/1976 | Oswald | 451/421 |
| 4,512,114 | A | | 4/1985 | Theien | 451/48 |
| 4,581,856 | A | | 4/1986 | Theien | 451/423 |
| 4,977,937 | A | * | 12/1990 | Hessenthaler | 144/241 |
| 4,987,704 | A | | 1/1991 | Johnson et al. | 451/419 |
| 5,331,769 | A | * | 7/1994 | Walton | 451/249 |
| 5,727,991 | A | * | 3/1998 | Main | 451/48 |

* cited by examiner

*Primary Examiner*—Joseph J. Hail, III
*Assistant Examiner*—David B. Thomas
(74) *Attorney, Agent, or Firm*—Sturm & Fix LLP

(57) ABSTRACT

A method and jointing attachment 10 for jointing the inserted tooth carbide heads 105 on the top 102 and bottom 103 rotary cutter heads of a thickness planer 100 having a movable carriage 104 that supports the bottom cutter head 103 and is provided with a laterally translatable grinding element 108 wherein the jointing attachment 10 includes an auxiliary motor member 40 that is mounted in a pivoted free floating fashion relative to the movable carriage 104 of the thickness planer 100 and supported by a drive belt member 50 that is attached to a selected one of the rotary cutter heads 102 103 and a pulley reel 43 mounted on the output shaft 42 of the auxiliary motor member 40 for imparting a counter-clockwise rotation of the selected cutter head 102 103 to joint the inserted tooth carbide heads 105 through engagement with the grinding element 108.

21 Claims, 4 Drawing Sheets

UNIVERSAL JOINTING ATTACHMENT FOR INSERTED TOOTH CARBIDE HEADS

BACKGROUND OF THE INVENTION

1. Field of the Invention

The present invention relates to the field of sharpening methods and apparatus in general and in particular to a universal jointing attachment for inserted tooth carbide heads.

2. Description of Related Art

As can be seen by reference to the following U.S. Pat. Nos. 993,367; 4,987,704; 4,581,856; and 4,512,114, the prior art is replete with myriad and diverse jointing arrangements for a variety of cutter heads used to produce different functions.

While all of the aforementioned prior art constructions are more than adequate for the basic purpose and function for which they have been specifically designed, they are uniformly deficient with respect to their failure to provide a simple, efficient, and practical universal jointing attachment for inserted tooth carbide heads in general and in particular for a specific type of thickness planer known in the industry as the Oliver "STRAITOPLANE"™.

The aforementioned thickness planer is provided with a pair of cutter heads which come in either 24", 30" or 36" wide wherein the upper cutter head is fixedly secured in the main or mill framework of the thickness planer and the bottom cutter head is disconnectable from the main drive motor of the mill and mounted on a carriage that can be laterally withdrawn relative to the mill.

At the present time, Oliver Manufacturing Company does not make a jointing attachment for their 'STRAITOPLANE"™ thickness planers, and users of that machine have encountered a great deal of difficulty in obtaining smooth cutting surfaces on the grinding knives provided thereon.

When grinding the individual knives, the allowable tolerances are between one and one and a half thousandths per inch and this process normally takes approximately 6 to 6½ hours to complete. However, the individual knives can be jointed from 3 to 5 times between each grinding procedure.

It should also be noted that once the grinding wheel makes contact with the guide behind the knives, the knives have to be turned. Given the fact that each knife has four sides, each knife can be jointed 4 to 5 more times thereby extending the life of the knives; and, with almost 300 knives installed on one thickness planer at an average cost of $11 per knife, this represents very substantial savings.

As a consequence of the foregoing situation, there has existed a longstanding need among owners of Oliver "STRAITOPLANE"™ thickness planers for a new and improved method and apparatus for jointing the inserted tooth carbide heads on both the upper and lower cutter heads of that device; and, the provision of such an arrangement is the stated objective of the present invention.

BRIEF SUMMARY OF THE INVENTION

Briefly stated, the universal jointing attachment that forms the basis of the present invention comprises in general a bracket unit, a mounting unit, an auxiliary motor unit and a drive belt unit which cooperate with the existing structural components on the Oliver Manufacturing Co. "STRAITOPLANE"™ thickness planers mentioned previously.

As will be explained in greater detail further on in the specification, the auxiliary motor unit is fixedly secured to the mounting unit which is pivotally connected to either an upper or a lower bracket unit which is affixed to a portion of the thickness planer and the drive belt unit suspends the auxiliary unit in a generally upright fashion relative to a selected one of the rotary cutter heads.

The motor unit is then actuated to impart counterclockwise rotation to the selected cutter head whose inserted tooth carbide heads are "jointed" by engagement with a grinding element that is laterally translatable relative to the selected cutter head.

In addition, the bracket unit and the mounting unit are specifically designed to allow for a 180° rotation of the output shaft of the auxiliary motor unit relative to the thickness planer, as well as, for the lateral displacement of the auxiliary motor unit relative to both the selected cutter head and the thickness planer for the purpose of properly aligning the drive belt unit to impart counterclockwise rotation to the selected cutter head during the "jointing" process.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
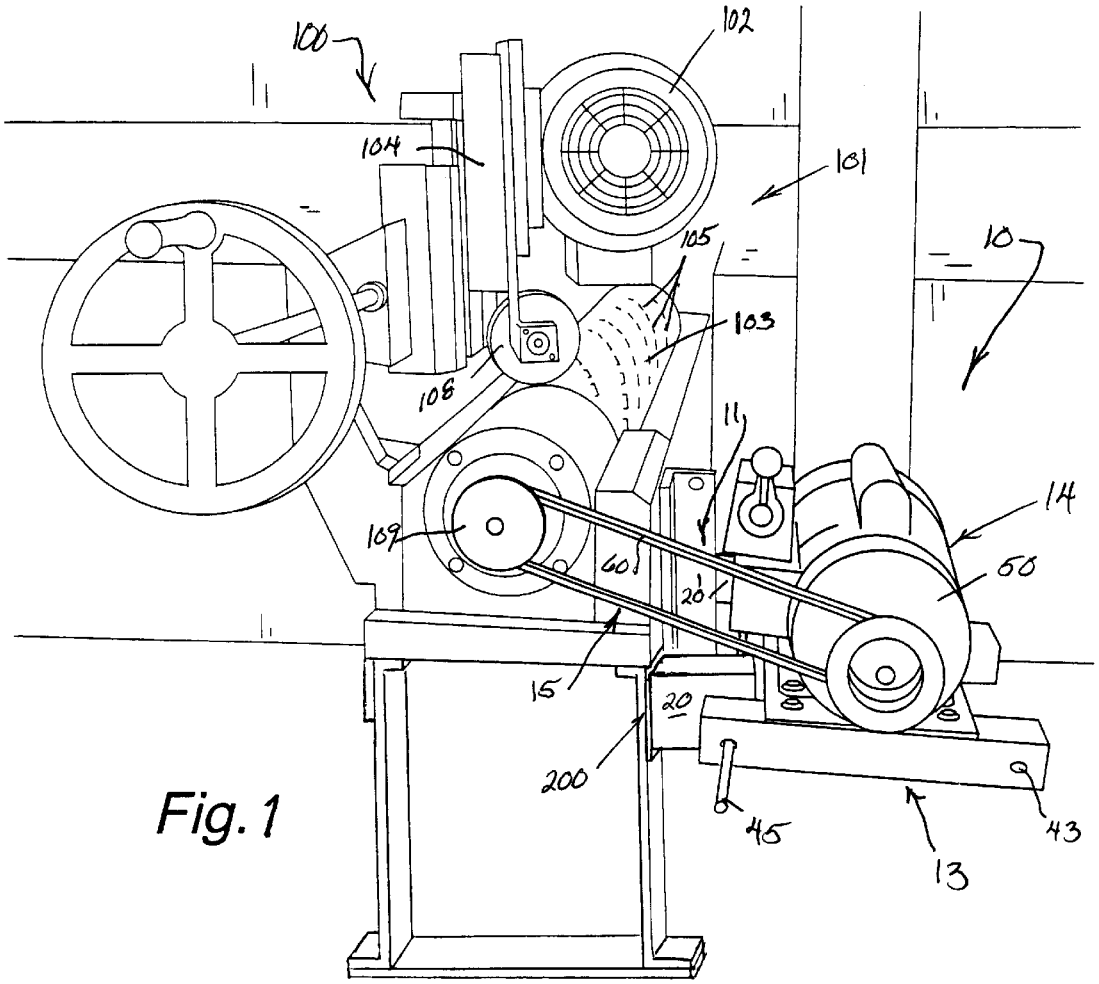
FIG. 1 is a perspective view of the universal jointing attachment suspended from a lower bracket unit that is installed on one model of the Oliver Manufacturing Co.'s thickness planers.

As can be seen by reference to the drawings, and in particular to FIG. 1, the universal jointing attachment that forms the basis of the present invention is designated generally by the reference numeral 10. The attachment 10 comprises in general a lower bracket unit 11, an upper bracket unit 12, a mounting unit 13, an auxiliary motor unit 14 and a drive belt unit 15. These units will now be described in seriatim fashion.

Prior to embarking on a detailed description of the universal jointing attachment 10, it would first be advisable to provide a detailed description of the specific thickness planer machine with which the jointing attachment 10 is specifically designed to be used.

As can be seen by reference to FIG. 1, the thickness planer machine designated generally by reference numeral 100 wherein both the top 102 and bottom 103 cutter heads are provided with a plurality of inserted tooth carbide heads 105 (hereinafter referred to as knives).

As can also be seen by reference to FIG. 1, the movable carriage 104, is provided with a conventional grinding element 108 that is normally employed in the aforementioned periodic "grinding" versus "jointing" of the cutter knives 105.

Figure 3:
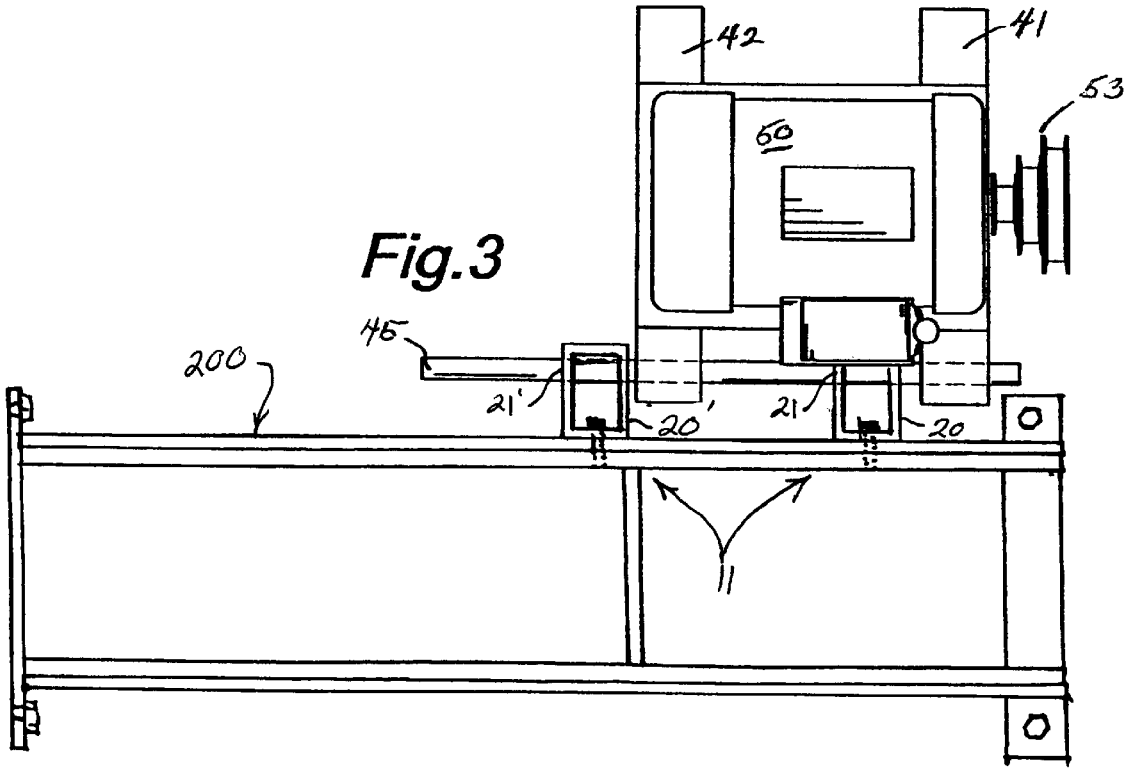
FIG. 3 is a top plan view of the jointing attachment installed on the lower bracket unit which is attached to a framework element suspended beneath the lower cutter head.

As can best be seen by reference to FIGS. 1 and 3, the lower bracket unit 11 is a part of framework element 200 and comprises a pair of independent bracket members 20 20' each having a generally open rectangular configuration wherein the opposed sides of each bracket member 20 20' are provided with aligned apertures 41 42; and wherein the inboard ends of each of the independent bracket members 20 20' are secured at spaced locations to a framework element 200 that is disposed beneath the lower cutter head 103 by ⅝" rod 45.

Figure 2:
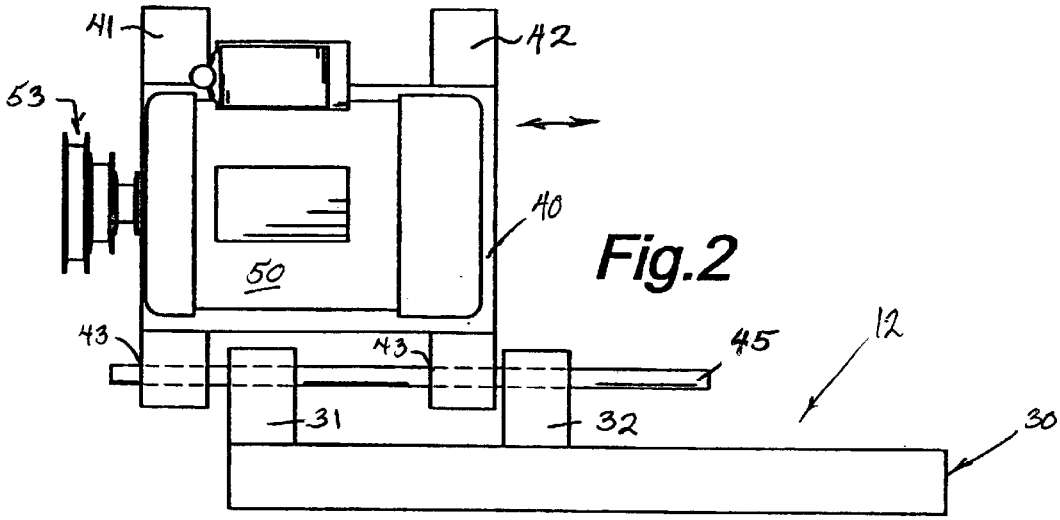
FIG. 2 is an isolated top plan view of the jointing attachment installed for left sided power take-off.
Figure 5:
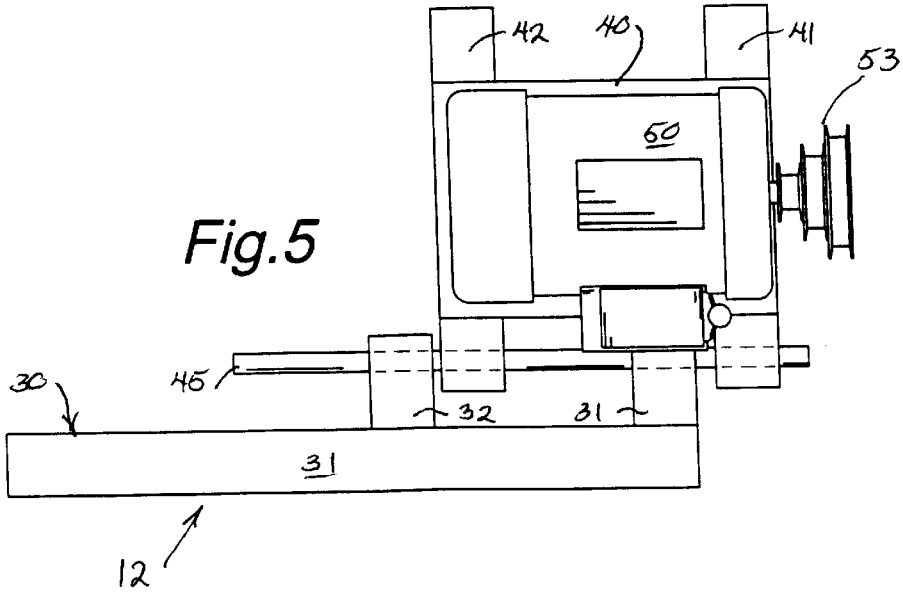
FIG. 5 is an isolated top plan view of the jointing attachment installed for left-sided power take off.
Figure 6:
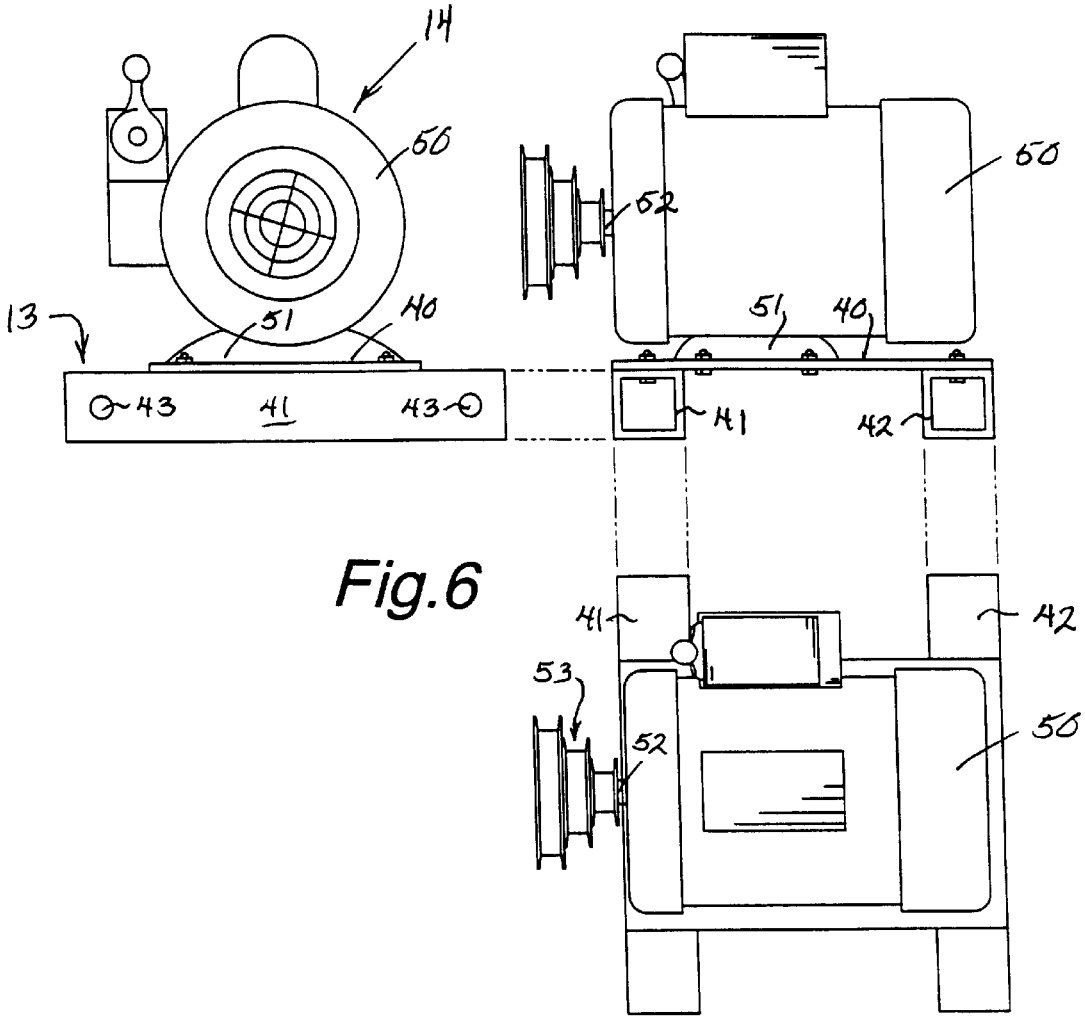
FIG. 6 is an isolated end side and top view of the auxiliary motor unit and mounting unit; and, FIG. 7 is an isolated end side and top plan view of the upper bracket unit.
Figure 7:
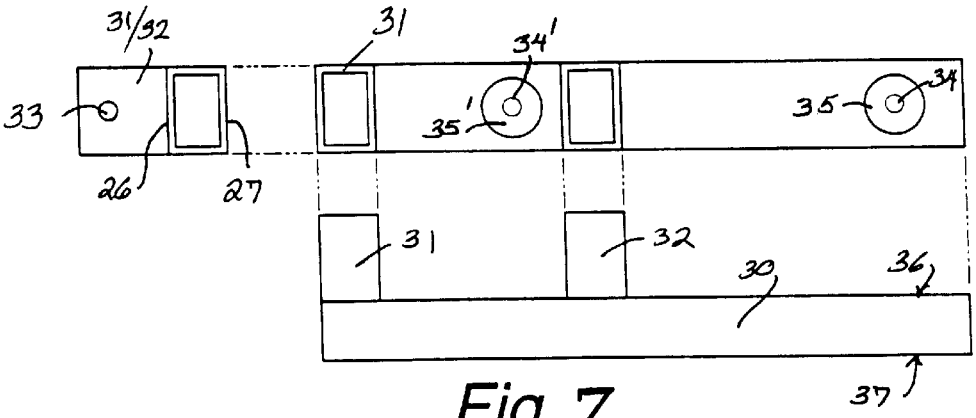

Turning now to FIGS. 2, 5 and 7, it can be seen that the upper bracket unit 12 comprises in general an elongated rectangular bracket bar member 30 provided with a pair of outwardly projecting bracket arms 31 32 wherein one bracket arm 31 is disposed proximate one end of the bracket bar member 30 and the other bracket arm 32 is disposed proximate to the midpoint of the bracket member 30 for reasons that will be explained presently.

Figure 4:
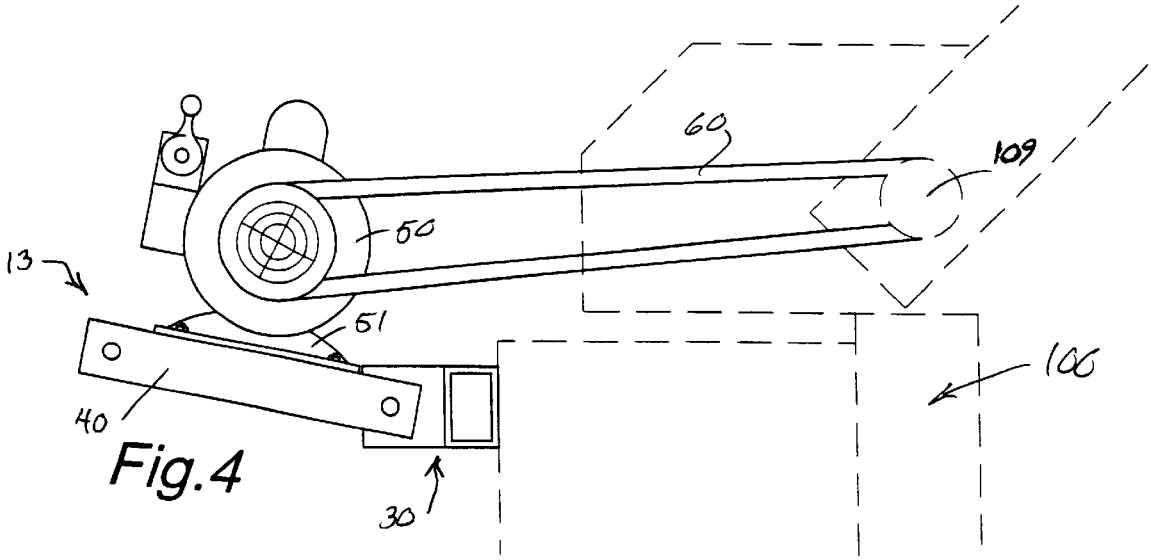
FIG. 4 is an isolated side view of the motor and mounting unit disposed on the upper bracket unit.

As can best be appreciated by reference to FIGS. 2 and. 5, each of the bracket arms 31 32 is provided with aligned apertures for ⅝" rod 45 dimensioned to receive a portion of the mounting unit 13 and the bracket bar member 30 is provided with two pairs of concentrically aligned apertures 31 32 wherein each pair includes a discrete aperture for rod 45 and an enlarged aperture 35 dimensioned to receive the stem and enlarged head respectively of conventional fasteners (not shown) for affixing the bracket bar member 30 to the upper portion of the thickness planer 100 in a well recognized fashion as depicted in FIG. 4.

Still referring to FIGS. 2 and 5, it can be seen that one pair 41 42 of the concentrically aligned apertures is disposed adjacent the end of the bracket bar member 30 that is not provided with a bracket arm and the other pair of concentrically aligned apertures 41 42 is disposed intermediate the bracket arms 31 32.

Furthermore, the enlarged apertures 35 are formed on the front face 36 of the bracket bar member 30 while smaller apertures 34 are formed in the rear face 37 of the bracket bar member 30.

As shown in FIGS. 2, 5 and 5, the mounting unit 13 comprises a generally flat rectangular plate 40 secured to a pair of generally hollow rectangular mounting arms 41 42 wherein each of the mounting arms 41 42 projects beyond the ends of the mounting plate 40 and wherein the opposite ends of each of the mounting arms 41 42 is provided with pairs of aligned apertures 43 that are dimensioned to receive an elongated mounting rod 45 as depicted in FIG. 1 for reasons that will be explained presently.

As shown in FIGS. 2 through 4, the auxiliary motor unit 14 in the preferred embodiment of the invention comprises a ¾ HP motor member 50 having a stanchion 51 that is fixedly secured to the base plate 40 of the mounting unit 13; wherein, the output shaft 52 of the motor member 50 is provided with a plurality of concentrically aligned pulley reels 53 whose purpose and function will be explained presently.

Turning now to FIGS. 1 and 4, it can be seen that the drive belt unit 15 comprises a selected drive belt member 60 that is dimensioned to engage the power take off reel 109 on either the 24", 30" or 36" width cutter heads 102 or 103 of the mill 101 whereby the drive belt member and the mounting rod 45 provide a "floating" mounting arrangement for the auxiliary motor member 50 such that the weight of the motor 50 bears directly on the cutter heads 102 or 103 to drive them in a counterclockwise direction during the jointing process.

At this juncture, it should be noted that the bracket unit 20 20' is employed t support the jointing attachment adjacent the lower cutter head 103 and the upper bracket unit 13 is employed to support the jointing attachment 10 on the framework element 200 that is disposed below the lower cutter head 103.

In addition, the mounting bar 45 is dimensioned so as to permit the motor unit 14 and the affixed mounting unit 13 to be laterally shifted to directly align a selected pulley reel 53 with the power take off reel 109 on the cutter heads 102 103 to eliminate any lateral torque forces on the drive belt member 60 during the jointing process.

The method of employing the jointing attachment 10 on a STRAITOPLANE™ thickness planer 100 is to attach either the lower bracket unit 11 or the upper bracket unit 12 at selected locations on the thickness planer 100 than employ the floating mounting unit 13 to position the motor unit 14 having the concentrically aligned pulley reel facing either toward or away from the mill 101 depending upon whether the upper 102 or lower 103 cutter head is intended to undergo the jointing process.

At this juncture, the drive belt member 60 is slipped over the appropriate power take off reel 109 and the motor unit 14 and mounting unit 13 are tilted upwardly to slip the opposite end of the drive belt member 60 over a selected one of the concentrically aligned pulley reels 53 mounted on the output shaft 52 of the motor member 50 which is then laterally shifted to align the drive belt member 60 in a straight line prior to allowing the drive belt member 60 to take on the full weight of the drive unit 14 and the mounting unit 13.

Once the jointing attachment 10 is attached to the thickness planer 100, the motor unit 14 is employed to impart counterclockwise rotation to the appropriate cutter head 102, 103 and once the cutter head rpm reaches the appropriate speed, the grinding element 108 is laterally displaced along the outboard side 107 of the carriage 104 to "joint" the knives 105 on the cutter head 102 or 103.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should e apparent that many substitutions, modifications, and variations of the invention are possible in light of the above teachings. It is therefore to be understood that the invention as taught and described herein is only to be limited to the extend of the breadth and scope of the appended claims.

I claim:

1. A jointing attachment for a thickness planer having a rotatable top cutter head and a rotatable bottom cutter head mounted on a movable carriage having an outboard side provided with a laterally displaceable grinding element and an inboard side wherein both of the cutter heads are provided with a plurality of inserted tooth carbide heads and the jointing attachment comprises an auxiliary motor member having an output shaft provided with at least one pulley reel, a drive belt unit including a drive belt member having one end adapted to be operatively connected to a selected one of said top and bottom cutter heads wherein the other end of the drive belt member is adapted to be operatively connected to said at least one pulley reel; and, means for mounting said auxiliary motor member in a free floating fashion relative to the thickness planer, whereby the drive belt member is used to support a portion of the auxiliary motor member relative to the inboard side of the movable carriage.

2. The jointing attachment as in claim 1; wherein, said auxiliary motor member is laterally displaceable relative to the thickness planer.

3. The jointing attachment as in claim 1; wherein, said auxiliary motor member is adapted to be selectively mounted relative to the inboard side of said carriage with the output shaft either facing away from, or facing toward said thickness planer.

4. The jointing attachment as in claim 2; wherein, said auxiliary motor member is adapted to be selectively mounted relative to the thickness planer with the output shaft either facing away from, or facing toward said thickness planer.

5. The jointing attachment as in claim 1; wherein, said auxiliary motor member is provided with a stanchion and said means for mounting said auxiliary motor member comprises at least in part a base plate fixedly secured to said stanchion and pivotally associated with the thickness planer.

6. The jointing attachment as in claim 5; wherein, the jointing attachment as in claim 1 wherein said auxiliary motor member is laterally displaceable relative to said thickness planer.

7. The jointing attachment as in claim 5; wherein, said means for mounting said auxiliary motor member in a free floating fashion further comprises at least in part: at least one mounting arm having one end attached to said base plate wherein the other end of said at least one mounting arm is pivotally associated with the thickness planer.

8. The jointing attachment as in claim 7; wherein, said means for mounting said auxiliary motor member further comprises at least in part: a bracket bar member fixedly secured to the inboard side of the movable carriage and having at least one outwardly projecting bracket arm that is pivotally associated with said at least one mounting arm.

9. The jointing attachment as in claim 5; wherein, said means for mounting said auxiliary motor member further comprises at least in part a pair of mounting arms fixedly attached to said base plate wherein both mounting arms have opposite ends which project beyond said base plate.

10. The jointing attachment as in claim 9; wherein, a selected pair of the opposite ends of the mounting arms are pivotally associated with the thickness planer.

11. The jointing attachment as in claim 10; wherein, said means for mounting said auxiliary motor member further comprises in part a mounting bracket bar fixedly secured to the thickness planer and provided with a pair of outwardly projecting bracket arms that are pivotally connected to said mounting arms.

12. The jointing attachment as in claim 11; wherein, the outwardly projecting bracket arms are provided with aligned apertures and the opposite ends of the mounting arms are provided with aligned apertures that may be selectively aligned with the aligned apertures in the bracket arms.

13. The jointing attachment as in claim 12; wherein, one bracket arm is disposed proximate to one end of said bracket bar member and the other bracket arm is disposed proximate the midpoint of said bracket bar member.

14. The jointing attachment as in claim 13; further comprising:

an elongated pivot rod member dimensioned to be received in said aligned apertures for pivotally suspending the auxiliary motor member from the thickness planer.

15. The jointing attachment as in claim 1; wherein, the output shaft of the auxiliary motor member is provided with a plurality of concentrically arranged pulley reels.

16. The jointing attachment as in claim 7; wherein said means for mounting said auxiliary motor member in a free floating fashion comprises at least in part:

a framework element disposed beneath the lower cutter head member and provided with a pair of independent spaced bracket members that are selectively pivotally associated with said auxiliary motor member.

17. The jointing attachment as in claim 8; wherein said means for mounting said auxiliary motor member in a free floating fashion comprises at least in part:

a framework element disposed beneath the lower cutter head member and provided with a pair of independent spaced bracket members that are selectively pivotally associated with said auxiliary motor member.

18. A method of jointing inserted tooth carbide heads on the top and bottom rotary cutter heads of a thickness planer wherein the thickness planer is provided with a laterally displaceable carriage that rotatably suspends the bottom cutter head and which is provided with a laterally displaceable grinding element including the steps of:

suspending an auxiliary motor member in a pivoted fashion from a first selected one of the rotary cutter heads and a portion of the thickness planer by a drive belt member that is operatively connected on one end to a selected portion of the selected one of the rotary cutter heads and operativley connected on the other end to a pulley reel disposed on the output shaft of the auxiliary motor member;

actuating the motor member to provide a counterclockwise rotation to the selected cutter head via the drive belt member; and, bringing the laterally displaceable grinding element into sequential engagement with selected ones of the inserted tooth carbide heads of the selected rotary cutter heads.

19. The method as in claim 18 further comprising the intermediate step of:

laterally displacing the auxiliary motor member relative to the selected portion of the thickness planer to align the drive belt member between the selected portion of the selected one of the rotary cutter heads and said pulley reel.

20. The method as in claim 19 further comprising the steps of:

detaching the drive belt member from the first selected one of the rotary cutter heads;

reattaching the drive belt member to the second selected one of the rotary cutter heads;

actuating the motor member to provide a counterclockwise rotation to the selected cutter head via the drive belt member; and bringing the laterally displacable grinding element into sequential engagement with selected ones of the inserted tooth carbide heads of the selected rotary cutter heads.

21. The method as in claim 20 further comprising the intermediate steps of:

reversing the orientation of the auxiliary motor member such that the output shaft of the auxiliary motor member is faced in the opposite direction; and, laterally displacing the auxiliary motor member relative to the selected portion of the thickness planer to align the drive belt member between the selected portion of the thickness planer to align the drive belt member between the selected portion of the selected one of the rotary cutter heads and said pulley reel.

* * * * *